US007819243B2

(12) United States Patent
Brophy et al.

(10) Patent No.: US 7,819,243 B2
(45) Date of Patent: Oct. 26, 2010

(54) BAR CODE BLOCKING PACKAGE

(75) Inventors: David Brophy, Mallow (IE); Joel A. Richardson, Naperville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 211 days.

(21) Appl. No.: 12/053,296

(22) Filed: Mar. 21, 2008

(65) Prior Publication Data

US 2008/0168747 A1 Jul. 17, 2008

Related U.S. Application Data

(63) Continuation-in-part of application No. 11/799,041, filed on Apr. 30, 2007, now Pat. No. 7,721,879.

(60) Provisional application No. 60/796,721, filed on May 2, 2006.

(51) Int. Cl.
*B65D 75/00* (2006.01)

(52) U.S. Cl. ..... 206/150; 206/497; 53/398; 53/441; 235/487; 283/91; 283/901

(58) Field of Classification Search ..... 206/145, 206/150, 151, 484, 484.2, 459.5, 427, 432, 206/497; 235/487, 484, 491, 494, 454; 53/398, 53/441, 446; 283/7, 91, 901
See application file for complete search history.

(56) References Cited

U.S. PATENT DOCUMENTS

| | | | | |
|---|---|---|---|---|
| 3,541,751 | A | | 11/1970 | Quebe et al. |
| 4,207,221 | A | | 6/1980 | Tobias et al. |
| 4,431,693 | A | * | 2/1984 | Skukowski ..... 206/459.5 |
| 4,521,466 | A | * | 6/1985 | White ..... 428/35.2 |
| 4,827,114 | A | | 5/1989 | Blachon |
| 5,074,399 | A | | 12/1991 | Kettle et al. |
| 5,492,222 | A | * | 2/1996 | Weaver ..... 206/459.5 |
| 5,502,304 | A | | 3/1996 | Berson et al. |
| 5,544,749 | A | * | 8/1996 | Watts ..... 206/459.5 |
| 5,667,071 | A | | 9/1997 | Nakagoshi et al. |
| 5,682,983 | A | | 11/1997 | Weaver et al. |
| 5,919,028 | A | | 7/1999 | Edqvist |
| 6,050,399 | A | | 4/2000 | Pratt |
| 6,234,945 | B1 | | 5/2001 | Weaver |
| 6,484,478 | B1 | | 11/2002 | Arends et al. |

(Continued)

FOREIGN PATENT DOCUMENTS

| | | |
|---|---|---|
| EP | 0 677 453 | 10/1995 |

(Continued)

OTHER PUBLICATIONS

Co-pending U.S. Appl. No. 11/799,054, filed Apr. 30, 2007, entitled "Bar Code Blocking System".

(Continued)

*Primary Examiner*—Luan K Bui
(74) *Attorney, Agent, or Firm*—Pauley Petersen & Erickson

(57) ABSTRACT

A method and apparatus for blocking a bar code in a package includes a carrier with a plurality of apertures. The carrier is formed with a plastic material containing an absorbing dye and a fluorescing dye so that a bar code on each container is not readable by a bar code scanner.

17 Claims, 6 Drawing Sheets

U.S. PATENT DOCUMENTS

| | | | | |
|---|---|---|---|---|
| 6,598,738 | B2 | 7/2003 | Weaver | |
| 6,688,465 | B2 | 2/2004 | Arends et al. | |
| 6,868,652 | B2 | 3/2005 | Arends et al. | |
| 6,880,313 | B1 | 4/2005 | Gessford et al. | |
| 2005/0161512 | A1 * | 7/2005 | Jones et al. | 235/487 |

FOREIGN PATENT DOCUMENTS

| | | |
|---|---|---|
| EP | 0 812 780 | 12/1997 |
| GB | 2 225 566 | 6/1990 |
| WO | WO 96/11140 | 4/1996 |

OTHER PUBLICATIONS

Co-pending U.S. Appl. No. 11/799,040, filed Apr. 30, 2007, entitled "Bar Code Blocking Package".
Co-pending U.S. Appl. No. 11/799,041, filed Apr. 30, 2007, entitled "Bar Code Blocking Package".
Co-pending U.S. Appl. No. 12/053,363, filed Mar. 21, 2008, entitled "Single Color Bar Code Printing On A Multi-Package".

* cited by examiner

BAR CODE BLOCKING PACKAGE

CROSS REFERENCE TO RELATED APPLICATION

This application is a Continuation in Part of U.S. patent application Ser. No. 11/799,041, filed 30 Apr. 2007, U.S. Pat. No. 7,721,879, which in turn claims benefit of U.S. Provisional Application No. 60/796,721 filed on 2 May 2006.

BACKGROUND OF THE INVENTION

1. Field of the Invention

This invention relates to a package of containers that facilitates proper bar code scanning.

2. Description of Prior Art

Conventional container carriers are often used to unitize a plurality of similarly sized containers, such as cans, bottles, jars and boxes and/or similar containers. Flexible plastic ring carriers are one such conventional container carrier. Other conventional packaging materials include stretch wraps and shrink wraps and/or labels.

Such flexible plastic ring carriers for cans and bottles may or may not have labels printed on the carrier. Often it is desirable to add a Universal Product Code (UPC) or "bar code" (the terms "UPC" and "bar code" are used interchangeably herein) to the container to identify individual containers and the carrier to identify the multi-container package, or multi-package. Containers within the multi-package that are individually coded with the bar code enable a bar code scanner or reader (also used interchangeably herein) to read product information, such as price.

Flexible plastic ring carriers may be used to unitize groups of four, six, eight, twelve or other suitable groups of containers into a convenient multi-package. In such cases, it is preferable to block any bar code on the individual container. This will prevent the bar code for individual containers from being read in place of or in addition to the bar code for the multi-pack. When such containers are placed within a multi-package such as a "six pack," difficulties may arise when container bar codes with individual container information are scanned instead of package bar codes with the information relevant to the multi-package or six pack.

Traditional multi-packages, such as six-packs, include containers that are positioned in random rotational orientations within the carrier. Each container generally includes an individual bar code which includes information, such as price, regarding the individual container. However, when the bar code for the individual container is scanned as the multi-package price, problems may arise for the vendor. Such problems primarily include a single container price being charged for a multi-container package and the inventory control problems that may result. For known stretch or shrink packaging, the bar code may be blocked by printing on the packaging material. Printing on prestretched or preshrunk materials requires careful design so the finished print appears normal.

As such, it is desirable to ensure that the correct bar code is scanned for the correct container and/or multi-package. More specifically, it may be desirable to block the bar codes of individual containers within a multi-package from the scanning process.

SUMMARY OF THE INVENTION

The present invention is directed to a package that includes a flexible carrier and a plurality of containers.

According to a preferred embodiment of this invention, a plurality of containers, such as cans, are positioned within a carrier manufactured with specifically selected blended dyes to both absorb laser light from the bar code reader and to replace that light absorbed to maintain the neutral color of the carrier. As a result, a bar code reader is less likely to read the bar code on each container.

The carrier of the present invention, although traditionally generally transparent, may additionally include an absorbing dye and a fluorescing dye. The area of the carrier that includes such dyes preferably extends across an entirety of the carrier however it may alternatively extend through a center of the carrier or across or along any other suitable area of the carrier.

Accordingly, the plurality of containers are positioned in the carrier so that each bar code is blocked by either the carrier and/or the containers are oriented in a rotationally inward position toward a center of the package and preferably toward an area of the carrier that includes the absorbing dye and the fluorescing dye. Alternatively, containers may be rotationally oriented in the carrier in any other suitable manner such that a bar code scanner is less likely to read individual bar codes on the respective containers. The area of the carrier that includes the absorbing dye and the fluorescing dye preferably prevents any light from the bar code scanner from contacting and reading the bar codes of the individual containers.

According to a preferred embodiment of this invention, the use of tailored dyes in the packaging materials blocks the scanning of bar codes while maintaining transparency. The resulting colorcast may be adjusted to a neutral grey color through the use of balancing dyes while maintaining the clarity of the carrier and only slightly reducing the transmittance of the packaging material. Additives, such as narrowly absorbing dyes, colored dyes, fillers and/or foaming agents may be used to either absorb the light of the scanning laser, to block the light of the laser and/or to scatter the light of the laser, thus reducing the contrast of the bar code scan to the point where the code is no longer readable.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
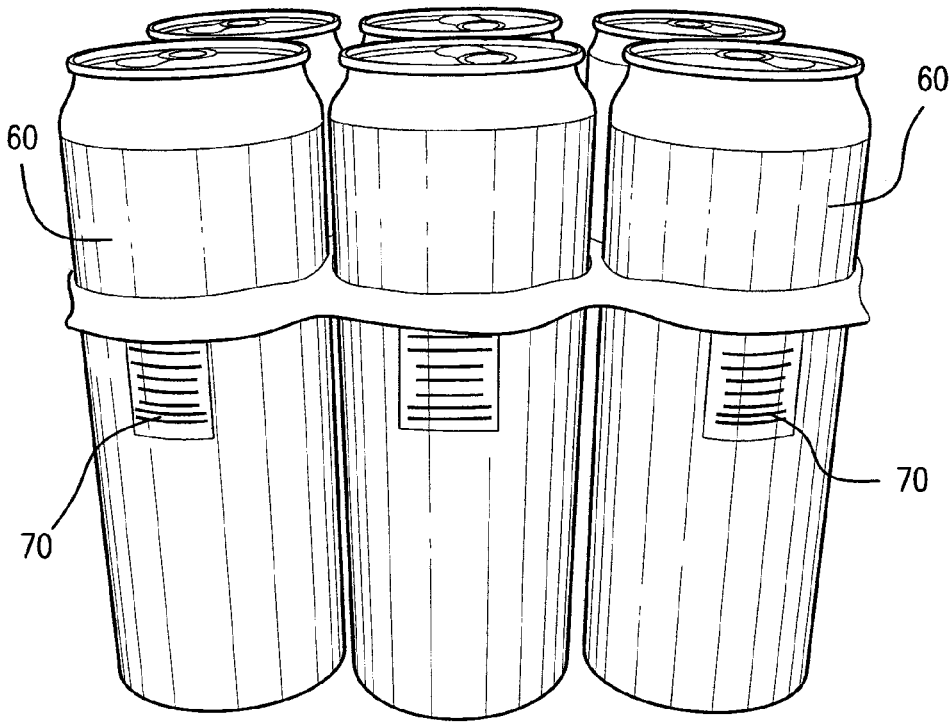
FIG. 1 PRIOR ART
FIG. 1 is a side view of a multi-package of containers assembled in a conventional manner with individual bar codes in random rotational orientations.

FIG. 1 shows a multi-package of six containers 60 unitized in a carrier to form a multi-packaging device. As shown, an exterior face of each container 60 includes a machine readable universal product code ("UPC"), referred to herein as bar code 70, printed thereon. Bar code 70 on each individual container 60 permits container 60 to be scanned by a bar code reader or scanner. When bar code 70 on container 60 is scanned by the bar code reader, information, such as the price, about the individual container 60 is retrieved from a computer connected with respect to the bar code reader. According to a preferred embodiment of this invention, the lines on bar code 70 are aligned in a generally horizontal orientation relative to container 60.

As shown in FIG. 1, a package of individual containers 60 comprises a unitized group of containers 20 sold as a multi-package. The unitized containers 60 are generally randomly oriented so that each container 60 is positioned in a different and/or random rotational orientation within the carrier. The package may have a separate bar code (not shown in FIG. 1) which allows information about the package, such as the price of the group of containers 60, to be retrieved when the separate bar code is scanned by the bar code reader. This separate "package" bar code may be printed on the exterior of the package or otherwise affixed to the package by suitable means, such as adhesive.

Figure 2:
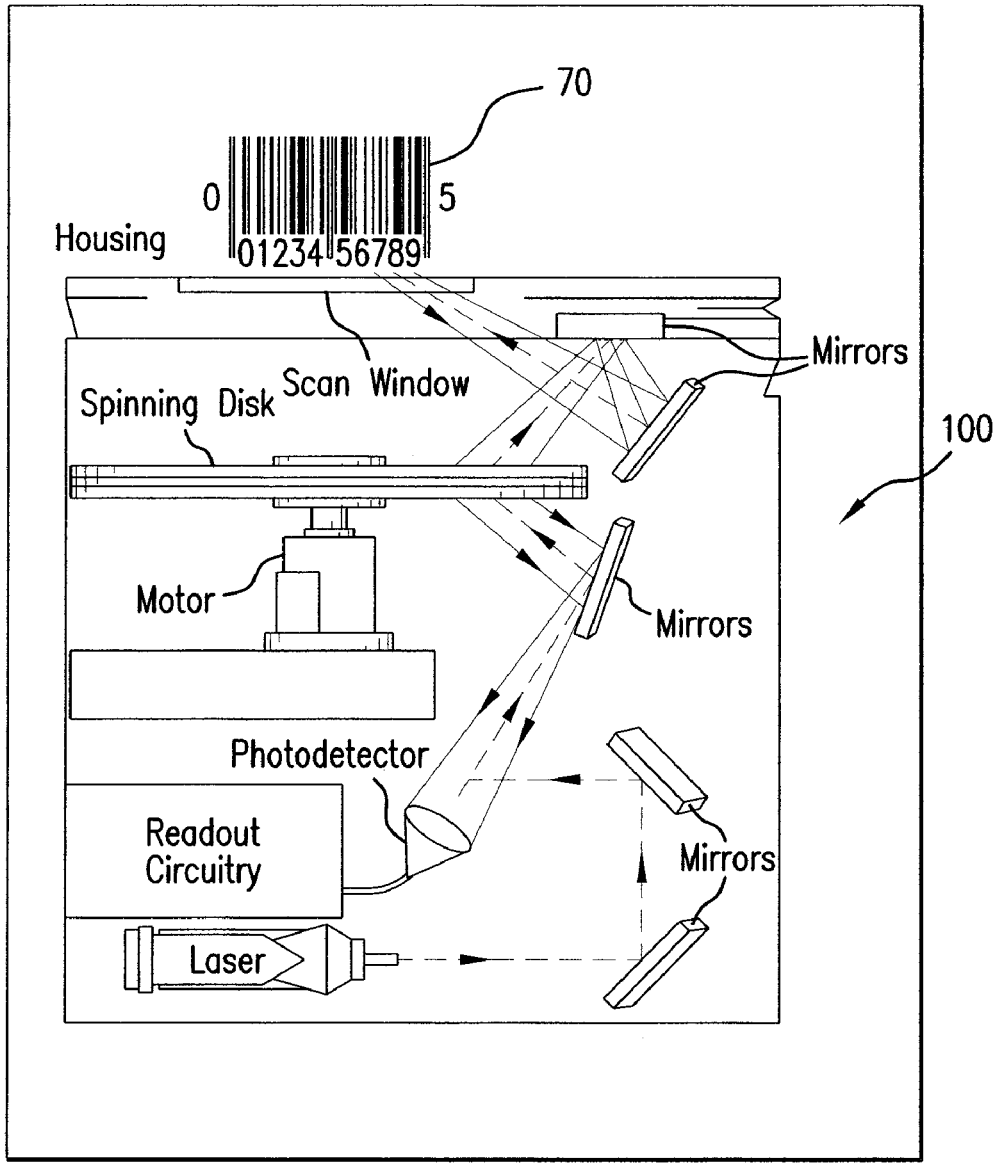
FIG.2 PRIOR ART
FIG. 2 is a schematic view of a typical bar code reader.

FIG. 2 shows a schematic of a conventional bar code scanner or reader 100. Bar code reader 100 traditionally uses laser light beams that are scanned across bar code 70 optically. In order to accept the broadest range of configurations, bar code readers 100 have been reported in the literature from wavelengths as low as 630 nm to 940 nm. Many point of sale bar code readers 100 fall in the range of 650 to 670 nm. The configuration of a typical point of sale bar code reader 100 is shown in FIG. 2. The laser beam is scanned across bar code 70 by moving the disk and/or the mirrors.

However, problems and mis-scans may arise if the bar code reader 100 instead scans bar code 70 of the individual containers 60 in lieu of the separate package bar code. Such mis-scans may result in a single container 60 price being charged for a multi-container package.

Figure 4:
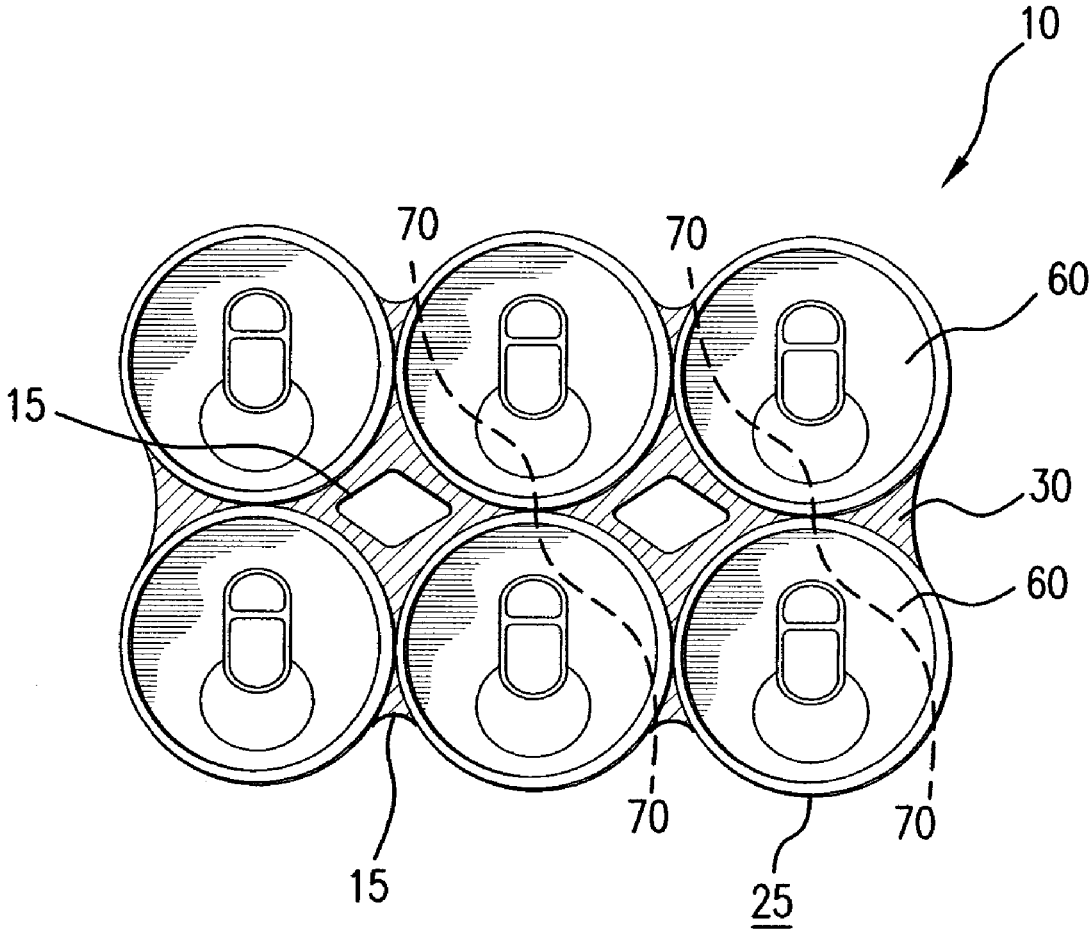
FIG. 4 is a top schematic view of a multi-package similar to a package according to one preferred embodiment of this invention.

FIG. 4 shows a top view of a multi-package 10 according to a preferred embodiment of this invention. As shown, multi-package 10 may include a plurality of containers 60, such as cans. Although FIG. 4 shows one preferred embodiment of this invention wherein each bar code 70 has been oriented into a preferably inward position relative to multi-package 10, an alternative embodiment of this invention includes carrier 15 applied in a suitable position over at least a portion of each respective bar code 70 such that specific orientation is not required. Although cans are shown in FIG. 4, bottles or any other commonly unitized container may be used in multi-package 10 according to this invention. Containers 60 are preferably, though not necessarily, like-sized within a single flexible carrier 10.

Each carrier 15 preferably includes sheet 20 having a width and length defining therein a plurality of container receiving apertures 25, each for receiving a single container 60. The plurality of container receiving apertures 25 are preferably arranged in longitudinal rows and longitudinal ranks so as to form an array of container receiving apertures 25, such as two rows by three ranks for a six container multi-package, two rows by six ranks for a twelve container multi-package, etc. Container receiving apertures 25 are preferably elongated in a longitudinal direction of carrier 10.

Sheet 20 and thus carrier 15 of the present invention are preferably substantially transparent and made of a suitable plastic material, preferably, generally transparent and preferably formed in extruded sheets, such as low to medium density polyethylene. In addition, according to a preferred embodiment of this invention, a light absorbing dye and a fluorescing dye are included in sheet 20, either as an additive during the forming process, such as during extrusion, or post process, such as with inks, tapes or similar post process applications.

According to a preferred embodiment of this invention, red dyes are identified and used that absorb the light at about 670 nm. Although traditionally referenced as an infrared absorber, such dyes are in fact visible light in the red region. Although various dyes absorb a significant amount of light in the proper wave band, such dyes do not consistently prevent a read of bar code 70. Additionally, the removal of red light from the generally transparent plastic material resulted in a definite blue cast to resulting carriers 15.

According to one embodiment of this invention, the color shift to blue is generally undesirable since bottlers, retailers and consumers generally prefer a neutral colored and/or generally transparent carrier 15. According to one embodiment of this invention, color correction through additional dyes to absorb blue light is generally undesirable as this solution could potentially have resulted in a grey carrier, neutral in color but with an overall attenuation in light transmission. Issues with the color shift, supply of the dyes, and the effectiveness of the UPC blocking effect all contributed to a requirement for an alternative solution, according to one embodiment of this invention.

Figure 3:
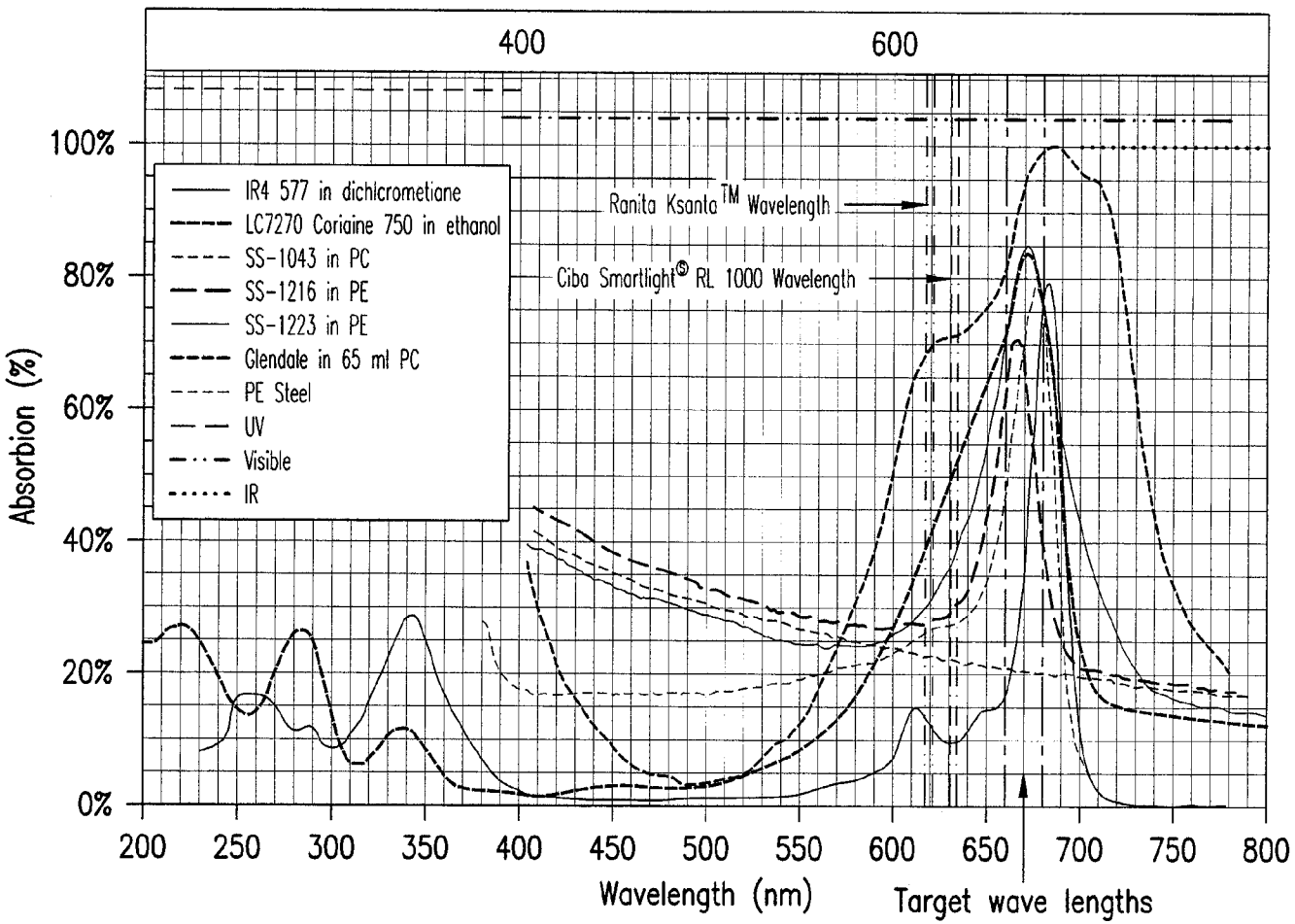
FIG. 3 is a graph showing absorption curves of various red absorbing dyes and fluorescence frequencies of two UV fluorescing dyes for use with preferred embodiments of this invention.

According to a preferred embodiment of this invention, the fluorescing dye comprises specifically a UV fluorescing dye or similar additives that absorb light in the UV region of the spectra and fluoresce in the red visible region of the spectra are desirable for use in connection with sheet 20. Examples of desirable additives include Ranita Ksanta™ which fluoresces at 600 to 630 nm, and Smartlight® RL 1000 by Ciba Specialty Chemicals which fluoresces at 630 to 640 nm. These materials may yield red hued polyethylene films or sheet 20. FIG. 3 shows absorption curves for various red absorbing dyes tested, the target range to be blocked and the fluorescence frequencies of two UV fluorescing dyes.

By coupling the two dyes, the red absorbing dyes in the range of 660 to 680 nm and the UV fluorescing dyes that translate light in UV wavelengths to the range of 600-640 nm, carrier 15 includes both enhanced blocking effect of the red absorbing dye through added red in the film, and enhanced blocking of color shift from the red absorbing dyes. By compensating for the loss in red by translating UV to the red wavelengths, the "graying" effect of the blue absorbers is minimized in carrier 15 while countering the blue shift by adding red instead of subtracting blue. This combination preferably blocks UPC scans of bar code 70 on individual containers 70 and/or multi-packages 10 while maintaining a neutral color. Additional additives may be included within carrier 15 including a third dye to fine tune a resulting color balance in carrier 15, for instance, to minimize "graying" of carrier 15 and/or enhance translucence of carrier 15.

As shown in FIG. 4, carrier 15 preferably includes sheet 20 having an absorbing dye and a fluorescing dye, such as a UV fluorescing dye, comprising an entire area 30 of sheet 20. This preferred embodiment of the invention preferably results from the absorbing dye, preferably the red absorbing dye and the fluorescing dye being added during the manufacturing process of sheet 20 and/or carrier 15. Such process preferably includes mixing pelletized plastic with the suitable dye additives before or during the extrusion process, extruding suitable sheet material and then punching such sheet material to form carriers 15. More preferably, the red absorbing dye and the fluorescing dye are mixed with plastic material to form a combined particle that is then suitable for extrusion.

Figure 5:
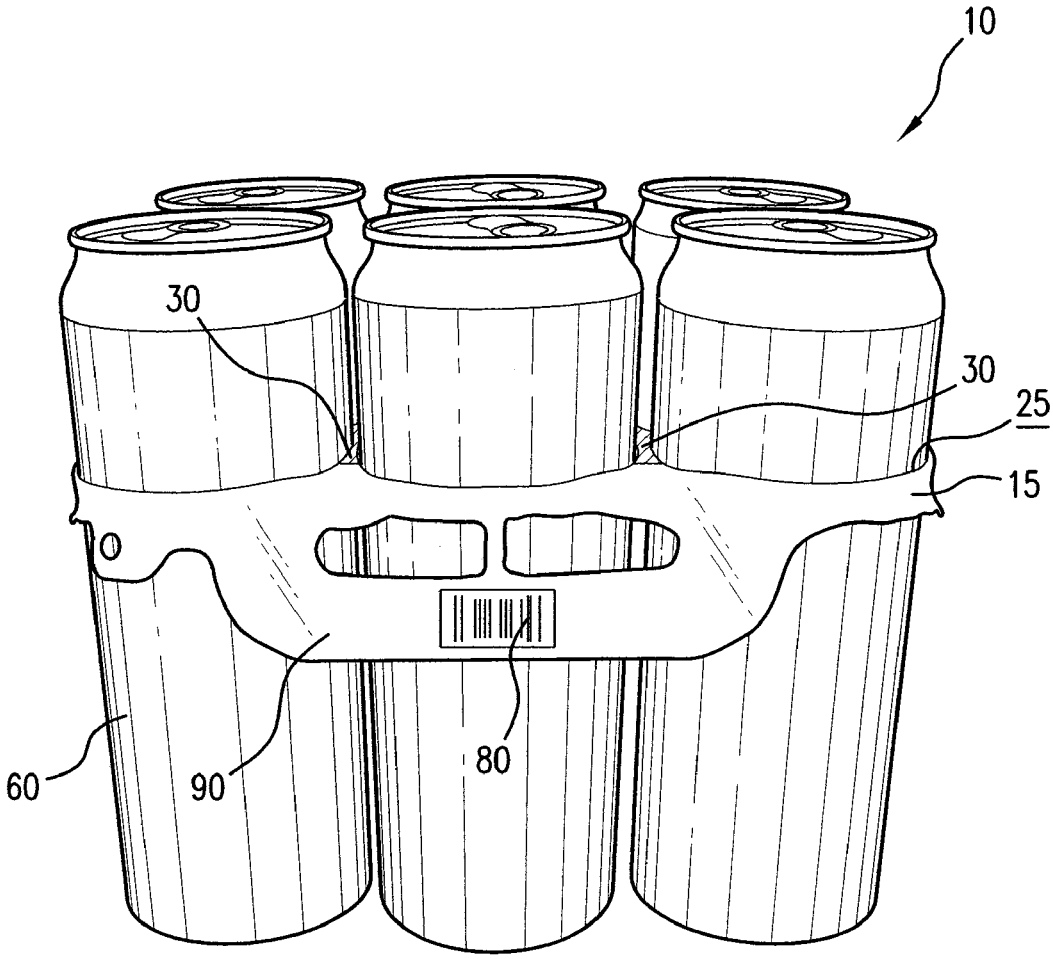
FIG. 5 is a side view of a multi-package of containers according to one preferred embodiment of this invention.

As shown in FIG. 5, carrier 15 is preferably applied around a sidewall of each respective container 60. As such, preferably directly overlaps with at least one line of each bar code 70 on each container 60, thereby preventing an effective scan by bar code reader 100, even when bar codes 70 are exposed along outer faces of containers 60.

Alternatively, such as shown in FIG. 5, carrier 15 may include a partial section or area 30 that is treated or otherwise processed to include the absorbing dye and the fluorescing dye. Area 30 preferably comprises a material and/or treatment that results in a portion of sheet 20 that absorbs or reflects light beams emitted from the bar code reader so that the bar code reader cannot read bar codes 70 on containers 60 which are covered or obscured, at least partially, by carrier 15. As used herein, "area" 30 is defined as all or part of carrier 15 including a process, treatment, ingredient, feature and/or quality that does not permit light beams from a bar code reader 100 to pass through carrier 15 and thus scan bar code 70.

As described, sheet 20 is formed of a generally transparent material and includes an array of container receiving apertures 25. Area 30 preferably extends through sheet 20 to comprise carrier 15 of the subject invention. As shown in FIG. 5, area 30 may extend within sheet 20 through a center of carrier 15, or on top of, underneath or between sheet 20. As such, area 30 may be adhered in sections or strips to sheet 20, such as with an adhesive; area 30 may be applied to sheet 20, such as with a hot stamp, an ink or paint; and/or area 30 may be manufactured into sheet 20, such as in a co-extrusion process.

According to one preferred embodiment of this invention wherein the absorbing dye and the fluorescing dye are homogeneously mixed within sheet 20, containers 60 may be placed within carrier 15 without regard to rotational orientation of bar codes 70 relative to multi-package 10.

According to another preferred embodiment of this invention, such as shown schematically in FIG. 4, the plurality of containers are rotationally oriented in the corresponding array of apertures so that each bar code 70 is positioned so that a bar code reader cannot scan each bar code 70. Although the inclusion of the absorbing dye and the fluorescing dye may alone prevent bar code reader 100 from scanning bar codes 70, such orientation may provide additional security.

Such orientation may be more preferable in an embodiment where a single area 30 of sheet 20 that includes the absorbing dye and the fluorescing dye is arranged along a center of carrier 15. As shown in FIG. 5, each bar code 70 is rotationally positioned inwardly toward area 30 and a center of a resulting package 10. However, opaque section 30 may be intermittently applied and/or positioned throughout carrier 15 based upon a desired location of bar code 70 on oriented containers 60. In any desirable configuration, each container 60 within carrier 15 may be rotationally oriented within carrier 15 so that bar code 70 is obstructed by an adjacent container 60 and/or by carrier 15.

Various desirable methods of orienting individual containers 60 are taught by Arends et al., U.S. Pat. No. 6,484,478; Arends et al., U.S. Pat. No. 6,688,465; and Arends et al., U.S. Pat. No. 6,868,652, which are each incorporated herein by reference.

According to one preferred embodiment of this invention, a second bar code 80 (or "multi-package code") may be positioned on handle 90, such as shown in FIG. 5, or other portion of package 10. The second bar code 80 may include information regarding the multi-package including new pricing and quantity information. Area 30 of sheet 20 thereby provides a dual role of blocking bar codes 70 on individual containers 60 and supporting the second bar code for multi-package labeling.

According to a preferred method of the subject invention, carrier 15 having a plurality of container receiving apertures 25 and sheet 20 having an absorbing dye and fluorescing dye area 30 is provided for engagement with a plurality of containers 60. Containers 60 are then positioned within carrier 15 and additionally may be oriented so that bar code 70 of each container 60 is blocked by adjacent containers 60 and/or area 30 of carrier 15. As described in the Arends et al. patents, incorporated herein be reference, each container 60 may be oriented before it is positioned within carrier 15; after container 60 is positioned within carrier 15 or some combination of orienting containers 60 before and after engagement with carrier 15.

According to one desired embodiment of this invention, each container 60 is oriented, prior to engagement with carrier 15, so that each bar code 70 faces a corresponding bar code 70 in a transversely adjacent container 60. Carrier 15 is then applied to a desired set of containers 60 resulting in a unitized package 10.

According to one preferred embodiment of this invention, the packaging material includes an absorbing dye, which absorbs narrowly near the wavelengths used by the scanner lasers, such as, for example, having peak absorbance in the range of between about 650 to about 670 nanometers. Typically, but not necessarily, the absorbing dye results in a light blue or cyan cast to the polymer sheet of packaging material. Desirably, the color may be perceived as neutral by balancing the "cyan" with narrow absorbing dyes yielding "magenta" and/or "yellow" when extruded, for example. The use of a tri-color approach to color balancing may allow greater flexibility and/or color compensation than a single dye system or a double dye system.

Careful selection of narrowly absorbing dyes may provide a perceived neutral color while allowing a substantial portion of the light energy to pass through resulting in transparency. According to a preferred embodiment of this invention, the color balanced dye maintains the clarity of the carrier and only reduces the transmittance of the carrier by less than about 30 percent and more desirably by less than about 20 percent.

Alternately, the invention may include ultraviolet absorbing additives that fluoresce in the red visible region of the spectra, for example and as discussed above. Ultraviolet absorbing additives may yield red hued films, such as, polyethylene, for example. With suitable dyes of this invention, the laser light from the bar code scanner may be absorbed easily and/or shifted outside the range that can be read by the sensors so the carrier may be perceived as "black" to the reader even if visible to human eyes.

Suitable packaging materials may include transparent films, stretch labels, shrink labels, stretch films, shrink films, heat shrink films and/or any other substance for at least partially containing one or more items. According to a preferred embodiment of this invention, a dye or pigment absorbs the light from the scanning laser without shifting color.

Alternately, a narrowly absorbing dye blocks the scanner laser light and leaves a perceptible colorcast due to the removal of red light, for example. Rebalancing the color by controlled absorption of other visible wavelengths may result in an overall reduction in light transmittance and a "gray" color. Desirably, fluorescing additives discussed above emit light in the red visible region of the spectra.

According to a preferred embodiment of this invention, a suitable mechanism to reduce the contrast of the bar code may be utilized, such as, for example, a blocking agent, an opaque pigment, a light scattering agent and/or any other substance prohibiting at least a portion of the bar code from being read by a reader. The term blocking agent broadly includes, without limitation, any suitable substance that at least partially absorbs and/or reflects a frequency of light (visible and/or invisible).

Alternately, talc and/or titanium dioxide (Ti02) may be extruded into a strip to provide a solid white color. Other suitable pigments are possible for a colored appearance. The term blocking refers to partially and/or completely obscuring the bar code, such as, for example, reducing the contrast below 20 percent. Additives may include fine pigments at low loadings, such as, diameters from fractions of a micrometer to several micrometers and ranging from less than about 0.1 percent to about 0.0001 percent, for example.

According to a preferred embodiment microscale or nanoscale pigments at reduced loadings may give transparent packaging a frosted rather than opaque appearance. Alternately, light scattering by the formation of fine bubbles in the carrier may block a bar code, such as, for example, with a chemical blowing agent, a nucleating agent and/or other suitable substance.

Other embodiments of this invention may include, the use of lane extrusion to limit the portion of the film containing the dyes and may be used with shrink or stretch film allowing the appearance to be tailored as needed to meet the packaging needs, such as, for example, polyethylene, polypropylene, polyvinyl chloride, polyethylene terephthalate, polyvinyl acetate and/or any other suitable polymer material. After extrusion as a film, the film can be handled as usual. Bar code blocking may be achieved with transparency and without printing on the film.

This invention also includes a method of packaging one or more items and rendering a bar code not generally readable by a bar code reader including: the step of providing one or more items with a bar code, the step of forming a sheet from a plastic material including a blocking agent, the step of engaging the one or more items with the sheet and the step of blocking the bar code from the bar code reader by at least a portion of the sheet.

EXAMPLES

Figure 6:
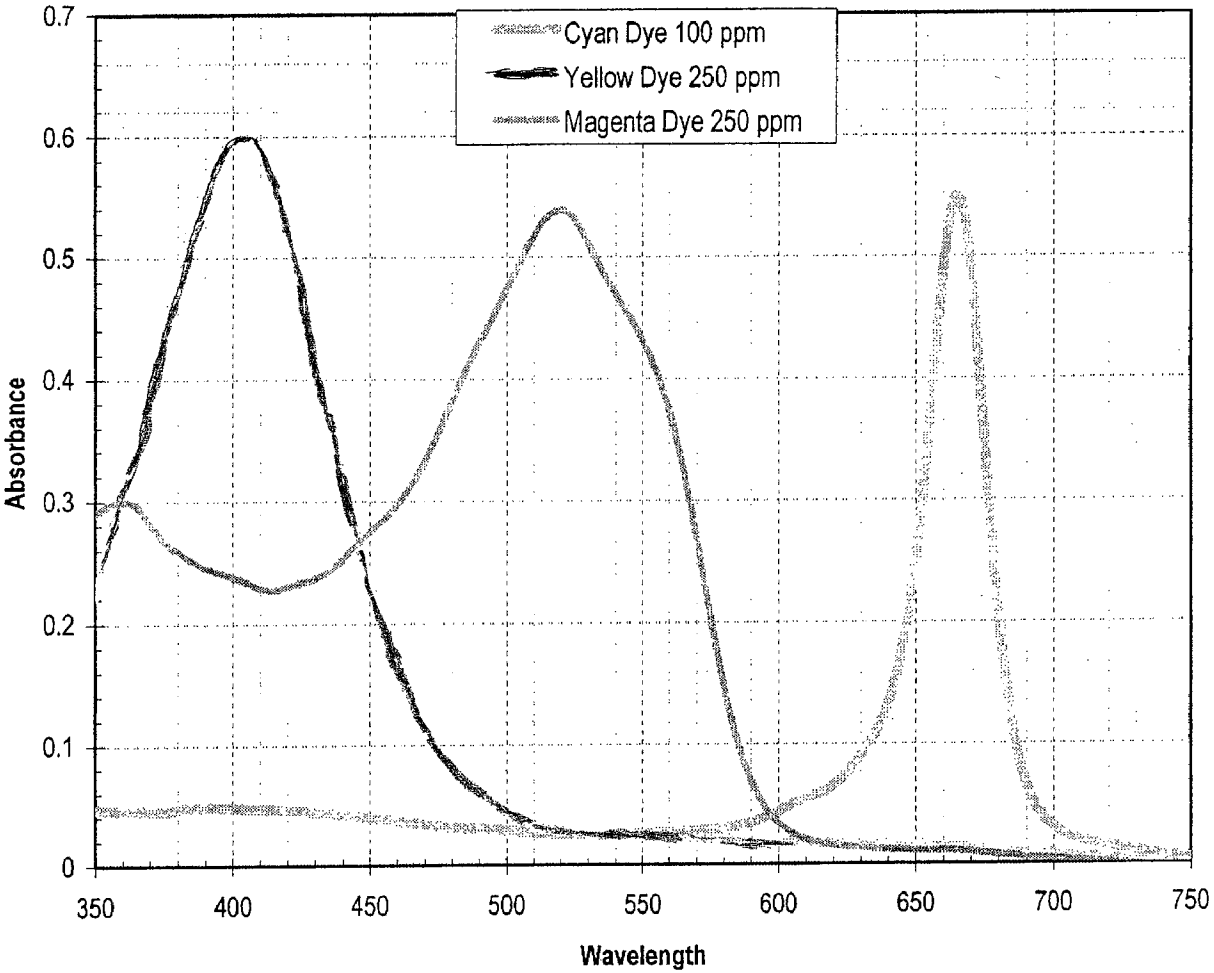
FIG. 6 is a graph showing absorption curves of various absorbing dyes for color balancing according to one preferred embodiment of this invention.

Selected dyes were compounded into a polyethylene resin. For these examples, separate concentrates were produced for each of the three colors: G2003-06-01 for the cyan dye (0.05% loading), G2003-06-02 for the yellow dye (0.50/0 loading), and G2003-06-03 for the magenta dye (0.5% loading). Absorbance curves for these three concentrates are given in FIG. 6.

After selecting a dye loading to provide a neutral color, the concentrates were blended with polyethylene and extruded into a 14-mil sheet using a 1 inch 24:1 single screw extruder and a inch coat hanger die with a standard casting roll stand. The resulting sheet included a uniform color and 6½ inch width. This dye loading in the sheet blocked the reading of a standard bar code. A BYK Gardiner Haze Gard Plus instrument measured total transmittance, haze and clarity for the sheet. As seen in Table 1 below, the transmittance of light was reduced by about 26% but haze was reduced by 7% and clarity improved by 1%. Text was easily readable through the sheet with graphics and/or colors remaining true.

TABLE 1

Measures of Sheet Clarity on Laboratory Produced Samples

| | Transmittance | | Haze | | Clarity | |
|---|---|---|---|---|---|---|
| Sample | Average | Std. Dev. | Average | Std. Dev. | Average | Std. Dev. |
| Control | 89.6 | 0.44 | 12.2 | 0.83 | 87.2 | 0.37 |
| Sheet Sample | 66.4 | 0.22 | 11.3 | 0.93 | 88.2 | 0.42 |

The effectiveness of these sheets at blocking bar code scanners was tested using a portable omni-directional scanner produced by Symbol Technologies, a CCD linear hand held scanner, model SC5USB, distributed by IDAutomation, and a Quickcheck™ PC Verifier produced by Hand Held Products. The Symbol Technologies scanner utilized a 650 nm laser and the other devices utilized 660 nm lasers. Scans were performed using a calibrated conformance standard test card supplied by GS1.

Neither the Symbol Technologies Omni-directional scanner nor the Quickcheck™ verifier were able to scan the standard bar codes in 25 tries. The CCO scanner would read the bar codes, but the reads were highly irregular with some instances of no reads in 25 attempts and other instances with occasional reads. The hand scanner is much brighter and the scan lines wider, but orientation had to be perfect to read the bar code.

While in the foregoing specification this invention has been described in relation to certain preferred embodiments thereof, and many details have been set forth for purpose of illustration, it will be apparent to those skilled in the art that package is susceptible to additional embodiments and that certain of the details described herein can be varied considerably without departing from the basic principles of the invention.

The invention claimed is:

1. A packaging material for a product with a bar code, the packaging material comprising:

a sheet formed of a generally transparent material including an absorbing dye within at least a portion of the sheet and the sheet generally blocking a bar code scanner from reading the bar code when the sheet is positioned between the product and the bar code scanner; and at least one additional absorbing dye including a magenta dye and a yellow dye for tri-color balancing and the tri-color balancing results in a neutral color.

2. The packaging material of claim 1, wherein the absorbing dye reduces a contrast between bars and spaces of the bar code to below about 20 percent.

3. The packaging material of claim 1, wherein the sheet is selected form one of the group consisting of stretch labels, shrink labels, stretch films and shrink films.

4. The packaging material of claim 1, wherein a peak absorbance of the dye is in the range of between about 630 nanometers and about 940 nanometers.

5. The packaging material of claim 1, wherein the peak absorbance of the dye is in the range of between about 650 nanometers and about 670 nanometers.

6. The packaging material of claim 1, wherein the absorbing dye colors the sheet cyan.

7. The packaging material of claim 1, wherein the absorbing dyes reduce transmittance by less than about 30 percent.

8. The packaging material of claim 1, further comprising a fluorescing dye.

9. The packaging material of claim 1, wherein the sheet includes at least one of the group consisting of polyethylene, polypropylene, polyvinyl chloride, polyethylene terephthalate, polyvinyl acetate and combinations thereof.

10. A packaging material for a product with a bar code, the packaging material comprising:

a sheet formed of a generally transparent material including a blocking agent within at least a portion of the sheet and the sheet generally blocking a bar code scanner from reading the bar code when the sheet is positioned between the product and the bar code scanner; and at least one additional blocking agent color balancing the sheet, wherein the at least one additional blocking agent includes a magenta dye and a yellow dye for tri-color balancing and the tri-color balancing results in a neutral color within the sheet.

11. The packaging material of claim 10, wherein the blocking agent includes a pigment.

12. The packaging material of claim 11, wherein the pigment includes titanium dioxide or talc.

13. The packaging material of claim 12, wherein the pigment is between about 0.1 percent and about 0.0001 percent.

14. The packaging material of claim 10, wherein blocking agent includes a chemical blowing agent forming fine bubbles within the sheet.

15. A method of packaging one or more items with a bar code and rendering a the bar code not generally readable by a bar code reader, the method comprising:

providing one or more items with a bar code;

forming a sheet from a transparent plastic material including a first blocking agent in at least a portion of the sheet for blocking the bar code reader and an additional blocking agent includes a magenta dye and a yellow dye for tri-color balancing and the tri-color balancing results in a neutral color within the sheet;

engaging the one or more items with the sheet; and blocking the bar code from the bar code reader by at least a the portion of the sheet.

16. The method of claim 15, wherein the step of engaging includes stretching the sheet or heat shrinking the sheet.

17. The method of claim 15, further comprising the step of orienting the one of more items relative to the sheet.

* * * * *